US006356253B2

(12) United States Patent
Uchino et al.

(10) Patent No.: US 6,356,253 B2
(45) **Date of Patent: *Mar. 12, 2002**

(54) ACTIVE-MATRIX DISPLAY DEVICE AND METHOD FOR DRIVING THE DISPLAY DEVICE TO REDUCE CROSS TALK

(75) Inventors: Katsuhide Uchino; Toshikazu Maekawa, both of Kanagawa (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/988,783

(22) Filed: Dec. 11, 1997

(30) Foreign Application Priority Data

Dec. 13, 1996 (JP) ..... 8-352986

(51) Int. Cl.[7] ..... G09G 3/36; G09G 5/10

(52) U.S. Cl. ..... 345/89; 345/94; 345/96; 345/690

(58) Field of Search ..... 345/94, 58, 87, 345/96, 208, 89, 147, 690

(56) References Cited

U.S. PATENT DOCUMENTS 5,379,050 A * 1/1995 Annis et al. ..... 345/94
5,426,447 A * 6/1995 Lee ..... 345/94
5,686,936 A * 11/1997 Maekawa et al. ..... 345/100
5,708,454 A * 1/1998 Katoh et al. ..... 345/100
5,764,207 A * 6/1998 Maekawa et al. ..... 345/94
5,774,106 A * 6/1998 Nitta et al. ..... 345/98
5,815,131 A * 9/1998 Taniguchi et al. ..... 345/94
5,959,600 A * 9/1999 Uchino et al. ..... 345/94

FOREIGN PATENT DOCUMENTS

EP 0 541 364 A1 5/1993 ..... G09G/3/36

* cited by examiner

*Primary Examiner*—Jeffery Brier
*Assistant Examiner*—Anthony Blackman
(74) *Attorney, Agent, or Firm*—Sonnenschein, Nath & Rosenthal

(57) ABSTRACT

An active-matrix display device includes rows of gate lines, columns of signal lines, and a matrix of liquid-crystal pixels provided in the region where the gate lines and the signal lines intersect. Vertical scanners sequentially scan each gate line during one vertical period, and select one row of liquid-crystal pixels. A horizontal scanner samples video signal for each signal line, and writes the video signal in the one row of liquid-crystal pixels selected within one horizontal period. A voltage applying means applies to each signal line a voltage equal to or less than the minimum level of the video signal in one horizontal period excluding a time assigned for writing the video signal in one row of liquid-crystal pixels. The repeated application of the voltage during one vertical period approximately equalizes signal leakages from all the pixels, whereby vertical crosstalk can be suppressed.

7 Claims, 9 Drawing Sheets

ACTIVE-MATRIX DISPLAY DEVICE AND METHOD FOR DRIVING THE DISPLAY DEVICE TO REDUCE CROSS TALK

BACKGROUND OF THE INVENTION

1. Field of the Invention

The present invention relates to an active-matrix display device using thin film transistors as pixel-driving switching devices and a method for driving the display devices, and in particular, to a technique for improving image quality by eliminating crosstalk (hereinafter referred to as "vertical crosstalk" if necessary) appearing in the vertical direction of a screen.

2. Description of the Related Art

The general structure of an active-matrix display device will be described with reference to FIG. 11. FIG. 11 consists of circuit diagrams showing two pixels extracted from the conventional active-matrix device. The active-matrix display device includes rows of gate lines X, columns of signal lines Y, and a matrix of liquid crystal pixels LC arranged in the region where the rows and the columns intersect. There are also formed thin film transistors Tr as switching devices for driving the pixels LC. The gate electrodes G of the thin film transistors Tr are connected to the corresponding gate lines X, and either the source electrodes S or the drain electrodes thereof are connected to the corresponding signal lines Y, with the other electrodes connected to the corresponding liquid-crystal pixels LC. In general, the pixels LC are driven by an alternating current. Thus, the polarity of a video signal to be written in each liquid-crystal pixel LC is inverted. Each drain electrode D and each source electrode S are alternately switched in accordance with this polarity inversion. Here, an electrode (H) having a high voltage is called a "drain electrode", and an electrode (L) having a low voltage is called a "source electrode S". A vertical scanning circuit (not shown) is connected to each gate line X. The vertical scanning circuit sequentially scans the gate lines X during one vertical period (1F), and selects one row of pixels LC every horizontal period (1H). In addition, a horizontal scanning circuit (not shown) is connected to each signal line Y. The horizontal scanning circuit samples a video signal Vsig for each signal line Y, and writes the video signal Vsig in the one row of pixels selected in one horizontal period.

The active-matrix display device has an inferior condition called vertical crosstalk. Thus, when the active-matrix display device is used in an apparatus such as a projector, generated image quality deteriorates, which is a problem to solve. As shown in FIG. 11, the vertical crosstalk is caused by the asymmetry of currents leaking from the thin film transistors Tr. In the condition shown in FIG. 11, left, the signal line Y is at level L, with the H-level signal written in the pixel LC. In this condition, a leakage current flowing when the gate electrode of the thin film transistor Tr is cut off is represented by $I_{off1}$. In addition, in FIG. 11, right, the thin film transistor LC is maintained at level L, the H-level signal is applied to the signal line Y. In this condition, a leakage current flowing when the gate electrode of the thin film transistor Tr is cut off is represented by $I_{off2}$. In general, $I_{off1}$ is larger than $I_{off2}$ because of the asymmetry of the thin film transistors Tr.

For example, as shown in FIG. 12, displaying a black window 30 in the center of a screen 20 generates vertical crosstalk in portions A, and the brightness of the portions A differs from normal portions B. A video signal Vsig to be written into each pixel LC is expressed by VsigC±ΔV where VsigC±ΔV represents a center potential, e.g., 6 volts; the symbol ± means that the video signal Vsig is inverted every horizontal period; and ΔV represents a change of Vsig in reference to VsigC. When the maximum change is represented by $\Delta V_{(MAX)}$, $\Delta V_{(MAX)}$ is, e.g., 4 volts. In normally white mode, VsigC±$\Delta V_{(MAX)}$ (=6±4 volts) is written in the black window 30.

Thus, a voltage of 10 or 2 volts is applied to the liquid-crystal pixels LC included in the black window 30. In addition, an intermediate-level video signal of 6±2 volts is written in the liquid-crystal pixels LC included in the background of the screen 20 excluding the black window 30. Accordingly, the background is grey, and a voltage of 8 or 4 volts is applied to each pixel LC.

FIG. 13 shows that the potentials of the pixels LC included in the portions A and B shown in FIG. 12 change during two vertical period (2F). During the change, the operating condition of the corresponding thin film transistors Tr chronologically changes. The periods of the change are represented by T1 to T4. The operating condition of the thin film transistors Tr corresponding to the pixels LC included in the portions A changes as shown in periods T1, T2 and T1 in the initial one vertical period (1F), and changes as shown in periods T3, T4 and T3 in the subsequent one vertical period. The operating condition of the thin film transistors Tr corresponding to the pixels LC included in the portions B changes as shown in period T1 in the initial one vertical period (1F), and changes as shown in period T3 in the subsequent one vertical period.

FIG. 14 schematically shows the operating conditions of each thin film transistor Tr in periods T1 to T4. In period T1, a voltage of 8 volts is applied to the corresponding pixel LC, and the potential of the signal line Y oscillates between 8 and 4 volts every horizontal period. The leakage current at this time flows in the direction of $I_{off1}$. In addition, in period T3, the pixel is at 4 volts, and the potential of the signal line Y oscillates between 4 and 8 volts. The leakage current flowing at this time has a polarity identical to that of current $I_{off2}$. The operating condition of the thin film transistors Tr included in portions B is alternately repeated between periods T1 and T3 every vertical period (1F). The pixel potential caused by the leakage current changes as represented by a dotted line shown in FIG. 13. The operating condition of the thin film transistors included in portions A is basically similar. However, a video signal of 2 or 10 volts is written in the pixels included in the window 30 during periods T2 or T4, which oscillates the signal line Y between 10 and 2 volts within the writing period. For example, during period T2, a voltage of 8 volts is applied to the pixels LC, which changes the potential of the signal line Y between 10 and 2 volts. The amounts of the leakage currents in periods T1 and T2 differ due to the asymmetry of the leakage currents. Accordingly, as shown in FIG. 13, the pixel potential slightly differs in portions A and B in period T2, which causes the vertical crosstalk. Similarly, in period T4, the potential of the pixel is maintained at 4 volts, while the potential of the signal line Y oscillates between 10 and 2 volts every horizontal period (1H). The leakage currents in the thin film transistors Tr differ in periods T3 and T4, which generates the difference in the pixel potential in portions A and B during period T4. In particular, differently from period T3, period T4 includes a condition where the signal line Y is at level L of 2 volts. Thus, the leakage current flowing increases, which causes portions A and B to have an extremely remarkable potential difference.

In addition, the active-matrix display device has a problem of having not only the above-described vertical crosstalk but also vertical fixed-pattern noise, which will be described by referring to FIG. 4. An example of the active-matrix display device includes rows of gate lines X and columns of signal lines Y, a matrix of pixels LC arranged in the region where the gate lines X and the signal lines Y intersect, and thin film transistors Tr for driving the pixels LC. The active-matrix display device includes a vertical scanner 1 which sequentially scans each gate line X, and selects one row of pixels LC every horizontal period. The active-matrix display device includes a horizontal scanning circuit 4 which samples video signal Vsig for each signal line Y, and writes video signal Vsig in one row of pixels LC selected every horizontal period. This horizontal scanning circuit 4 consists of horizontal switches HSW provided at ends of the respective signal lines Y, and a horizontal scanner 4 for sequentially switching the horizontal switches HSW. The signal lines Y are connected to a video line 2 via the horizontal switches HSW. This video line 2 is supplied with video signal Vsig from a signal driver 3. The horizontal scanner 4 outputs sampling pulses $\phi_{H1}$, $\phi_{H2}$, and $\phi_{H3}$ to $\phi_{HN}$.

FIG. 5 shows the waveforms of sampling pulses $\phi_{1H}$, $\phi_{H2}$ and $\phi_{H3}$ sequentially output from the horizontal scanner 4 shown in FIG. 4. As the number of pixels increases in accordance with high integration of an active-matrix display device, a video-signal sampling rate accelerates. As a result, there appears a change in the width $\tau_H$ of each sampling pulse. When each sampling pulse is applied to the corresponding horizontal switch HSW, video signal Vsig supplied from the video line 2 is sampled for each signal line Y via the horizontal switch HSW in conduction. Since each signal line Y has a predetermined capacitance component, each signal line Y charges or discharges in accordance with each sampling pulse. This causes the video line 2 to obtain potential. As described above, increasing the sampling rate causes each sampling pulse to have a different width. Thus, the amount of charging or discharging is not constant, and the potential of the video line 2 changes. Since this potential change is superimposed on video signal Vsig, vertical fixed-pattern noise is generated in a displayed image, so that the image quality deteriorates disadvantageously.

In order to solve this problem, there is a proposed precharge method, which is disclosed in, for example, Japanese Unexamined Patent Publication No. 7-295521 which was filed by the assignee of the present application. In FIG. 6 is shown a precharge active-matrix display device. This precharge active-matrix display device is basically similar to the active-matrix display device according to the present invention. Accordingly, components corresponding to those in FIG. 1 are denoted by the corresponding reference numerals for facile understanding. As shown in FIG. 6, the precharge active-matrix display device includes a precharge means 5*a* which supplies predetermined voltage signal (precharge signal) Psig to each signal line Y just before video signal Vsig is written in one row of liquid-crystal pixels, and which reduces the amount of charging or discharging by each signal line Y. In this case, the precharge means 5 includes a plurality of switches PSW connected to ends of the signal lines Y, and a control means 6*a* for applying precharge signal Psig to the signal lines Y by simultaneously switching the switches PSW. This control means 6*a* simultaneously switches the switches PSW by outputting control pulses PC. Precharge signal Psig is supplied from a signal source 7*a* provided separately from a signal drive 3. This precharge signal Psig has a grey level (intermediate level), differently from video signal Vsig changing between while level and black level.

The operation of the active-matrix display device shown in FIG. 6 will be described below by referring to a timing chart shown in FIG. 7.

Vertical clock signal VCK input to the vertical scanner 1 has a pulse width corresponding to one horizontal period. Control pulses PC output from the control means 6*a* are output within a horizontal non-effective period such as a horizontal blanking period. Horizontal start pulses HST supplied to the horizontal scanner 4 are output every horizontal period, just after control pulses PC are output, which start the sampling of video signal Vsig. The sampling of video signal Vsig is successively performed synchronizing with horizontal clock signal HCK supplied to the horizontal scanner 4. In addition, since the polarity of video signal Vsig supplied from the signal driver 3 via the video line 2 is inverted every horizontal period, ac driving is performed. In accordance with this polarity inversion, the polarity of precharge signal Psig supplied from the signal source 7*a* is also inverted every horizontal period so as to coincide with the polarity of video signal Vsig. Precharge signal Psig has a potential level Vp with reference to the center potential VsigC of video signal Vsig, and represents the grey level positioned between the white level and the black level. The potential level of precharge signal Psig is basically set at the grey level (intermediate level) whose uniformity is most easily recognized in visual characteristics. The bottom waveform in the timing chart represents a change in potential VY applied to each signal line Y. When control signal PC is output at the start of one horizontal period and the switches PSW are in conduction, precharge signal Psig is applied to all the signal lines Y so that their capacitance components can charge or discharge. The application of precharge signal Psig changes the potential of each signal line Y to level Vp. Subsequently, actual video signal Vsig is sampled for each signal line Y, and the potential of the signal Y changes in accordance with video signal Vsig to perform writing. Potential change Δv caused by writing decreases to Vsig−Vp, which reduces the amount of charging or discharging. This enables control of a shift in the potential of the video line 2, which remarkably improves uniformity. In the above-described precharge method, all the signal lines Y are precharged up to intermediate-level potential at timing with no influence on a display image, such as a horizontal blanking period, signal-line charging or discharging current generated when actual video signal Vsig is sampled is reduced to control a shift in the potential of the video line 2. In other words, the switches PSW are used to finish charging or discharging each signal line Y in the blanking interval, and charging or discharging current caused by the actual video signal Vsig is generated by the difference in potential level between precharge signal Psig and video signal Vsig.

The level setting of precharge signal Psig has a problem to solve, which is shown in FIG. 8. The closer to the level of video signal Vsig, the more preferable the level of precharge signal Psig. In particular, when the level of precharge signal Psig is fixed at a predetermined level, it is preferable to set the level of precharge signal Psig at grey level which remarkably generates vertical fixed-pattern noise. In FIG. 8, the grey level is represented by dotted lines $Psig^H{}_2$ and $Psig^L{}_2$. The setting at the grey level generates vertical crosstalk. Accordingly, it is preferable to increase the amplitude of precharge signal Psig. The amplitude is represented by $Psig^H{}_1$ and $Psig^L{}_1$. In particular, by setting amplitude $Psig^L{}_1$, to the minimum level of video signal Vsig or less in a period during which video signal Vsig is at low level, the vertical crosstalk can be remarkably controlled. Therefore, the vertical fixed-pattern noise is generated when setting the level of voltage signal (precharge signal) Psig to a voltage ($Psig^H{}_2$ or $Psig^L{}_2$) at which the vertical fixed-pattern noise least appear or when setting the level of voltage signal (precharge signal) Psig to a voltage ($Psig^{H1}$, or $Psig^{L}_{1}$) at which the vertical crosstalk does not appear.

SUMMARY OF THE INVENTION

Accordingly, it is an object of the present invention to provide an active-matrix display device and a method for driving the display device in which image quality is improved by eliminating vertical crosstalk and fixed-pattern noise.

To this end, according to an aspect of the present invention, the foregoing object has been achieved through provision of an active-matrix display device including: a plurality of rows of gate lines; a plurality of columns of signal lines; a matrix of pixels provided in the region where the gate lines and the signal lines intersect; a vertical scanning circuit for sequentially scanning the gate lines in one vertical period, and selecting one row of pixels every horizontal period; a horizontal scanning circuit for sampling a video signal for each signal line before writing the video signal in the selected one row of pixels; and a voltage applying circuit for applying to each signal line a voltage equal to or less than the minimum level of the video signal in one horizontal period excluding a time assigned for writing the video signal in one row of pixels.

Preferably, the voltage applying circuit repeatedly adjusts signal leakages from all the pixels to an almost equal value during one vertical period.

The voltage applying circuit may comprise a circuit for precharging each signal line by changing a voltage equal to or less than the minimum level of the video signal to the intermediate level of the video signal and applying the changed voltage to each signal line after applying the voltage equal to or less than the minimum level of the video signal to each signal line before the horizontal scanning circuit writes the video signal in each signal line.

The horizontal scanning circuit may write the video signal, whose polarity is inverted every horizontal period, and the voltage applying circuit may apply to each signal line a voltage equal to or less than the minimum level of the video signal having either polarity in a horizontal period during which the video signal having either polarity is written.

According to another aspect of the present invention, the foregoing object has been achieved through provision of an active-matrix driving method for driving an active-matrix display device including a plurality of rows of gate lines, a plurality of columns of signal lines, and a matrix of pixels provided in the region where the gate lines and the signal lines intersect, in which the active-matrix driving method comprises the steps of: vertical scanning for sequentially scanning the gate lines during one vertical period, and selecting one row of pixels every horizontal period; horizontal scanning for sampling a video signal for each signal line before writing the video signal in the selected one row of pixels; and applying a voltage equal to or less than the minimum level of the video signal in one horizontal period excluding a time assigned for writing the video signal in one row of pixels, and repeatedly performing the voltage application to adjust signal leakages from all the pixels to an almost equal value.

Preferably, after the voltage equal to or less than the minimum level of the video signal is applied and before the video signal is written, the voltage is changed to the intermediate level of the video signal and the changed voltage is used to charge each signal line.

The video signal, whose polarity is inverted every horizontal period, may be written, and in a horizontal period during which the video signal having either polarity is written, the voltage equal to or less than the minimum level of the video signal may be applied to each signal line.

According to the active-matrix display device, when it is applied to, e.g., a projector, intense light from a light source is incident on a panel to generate vertical crosstalk. This vertical crosstalk is caused by the asymmetry of leakage current from thin film transistors. Therefore, according to the present invention, a voltage equal to or less than a video signal is input to all signal lines so that signal leakages from all pixels can be approximately equalized, which prevents the vertical crosstalk from occurring.

DESCRIPTION OF THE PREFERRED EMBODIMENTS

Preferred embodiments of the present invention will be described with reference to the attached drawings.

Figure 1A:
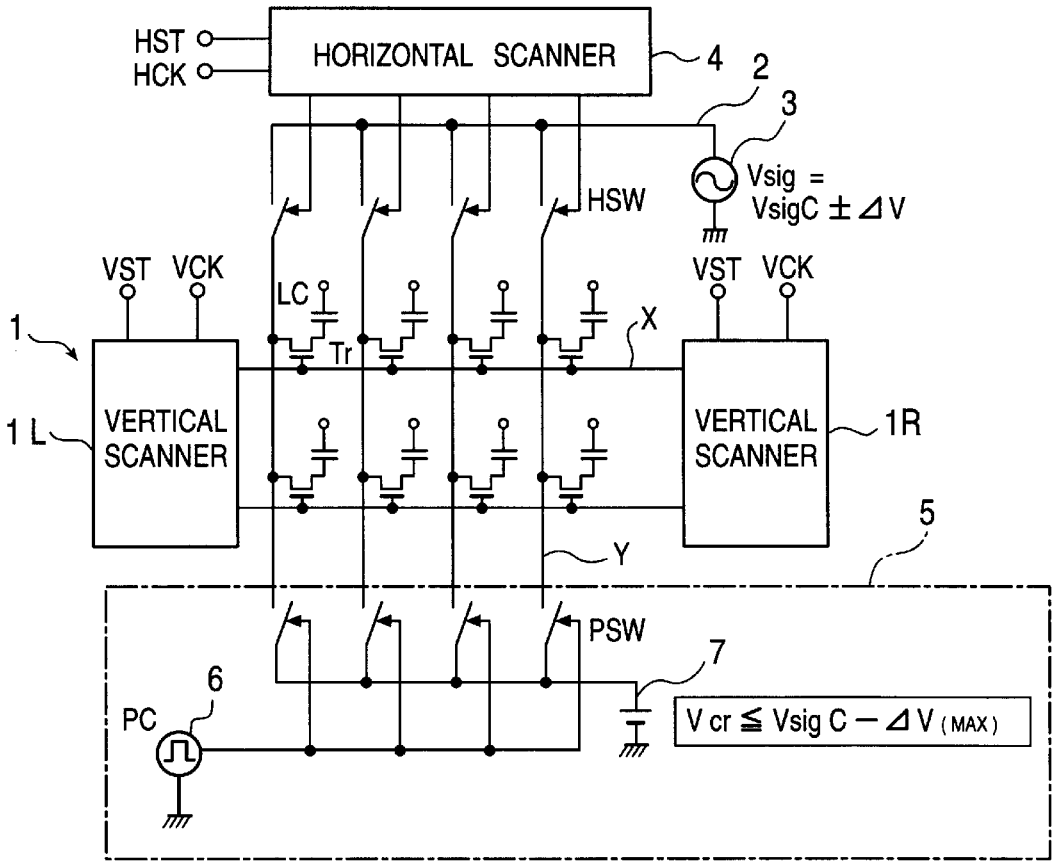
FIG. 1A is a circuit diagram showing an active-matrix display device according to a first embodiment of the present invention.

FIG. 1A shows the circuit diagram of an active-matrix display device according to a first embodiment of the present invention. The active-matrix display device includes rows of gate lines X and columns of signal lines Y. Liquid-crystal pixels LC are arranged in the region where the gate lines X and the signal lines Y intersect. The active-matrix display device according to the first embodiment includes the liquid-crystal pixels LC, and it need hardly be said that the pixels LC may comprise another electro-optical material. The liquid-crystal pixels LC are driven by thin film transistors Tr. Electrodes of the thin film transistors Tr are connected to the corresponding signal lines Y, other electrodes thereof are connected to the liquid-crystal pixels LC, and the gate electrodes thereof are connected o the corresponding gate lines X. Right and left vertical scanners 1L and 1R are connected to each gate line X to form a vertical scanning circuit. The vertical scanners 1L and 1R sequentially transfer vertical start pulses VST in accordance with predetermined clock signal VCK, and supply the gate lines X with selection pulses. Thereby, the gate lines X are sequentially scanned during one vertical period, and one row of pixels LC is selected every horizontal period. In addition, the signal lines Y are connected to a video line 2 via horizontal switches HSW. Video signal Vsig=VsigC±ΔV is supplied to the video line 2 from a signal driver 3. The active-matrix display device includes a horizontal scanner 4 for switching the horizontal switches HSW. The horizontal scanner 4 sequentially transfers horizontal start pulses HST while synchronizing with predetermined clock signal HCK, and outputs sampling pulses to switch the horizontal switches HSW. The horizontal scanner 4 and the horizontal switches HSW form a horizontal scanning circuit, which samples video signal Vsig for each signal line Y and which writes video signal Vsig in one row of pixels LC selected in one horizontal period through the thin film transistors Tr in conduction.

One characteristic of the present invention is that the active-matrix display device includes a voltage applying means 5. This voltage applying means 5 applies to each signal line Y, voltage Vcr equal to or less than the minimum level of video signal Vsig in one horizontal period excluding a time assigned for writing video signal Vsig in one row of pixels LC. Voltage Vcr is expressed as $Vcr \leqq VsigC-\Delta V_{(MAX)}$. By repeatedly applying voltage Vcr during one vertical period, signal leakages from all the pixels LC are uniformly adjusted. According to the first embodiment, the voltage applying means 5, provided separately from the horizontal scanning circuit 4, includes a plurality of switches PSW connected to ends of the signal lines Y, a control means 6 for applying voltage signal Vcr to each signal line Y by simultaneously switching the switches PSW. The control means 6 outputs control pulses PC. Voltage signal Vcr is supplied from a signal source 7 provided separately from the signal driver 3.

The active-matrix display device shown in FIG. 1A will be described below by referring to FIG. 1B.

Figure 13:
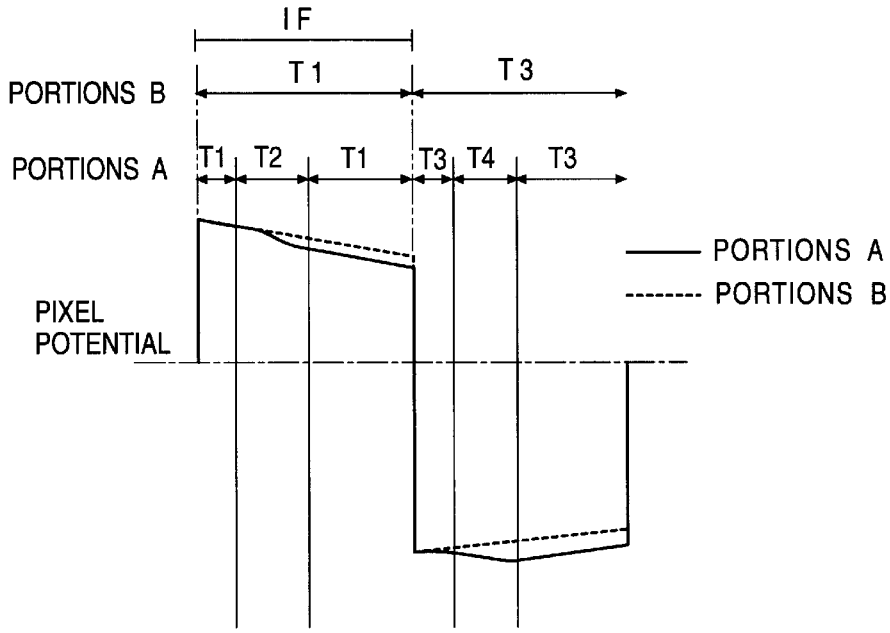
FIG. 13 is a chart illustrating problems in an example.
Figure 14:
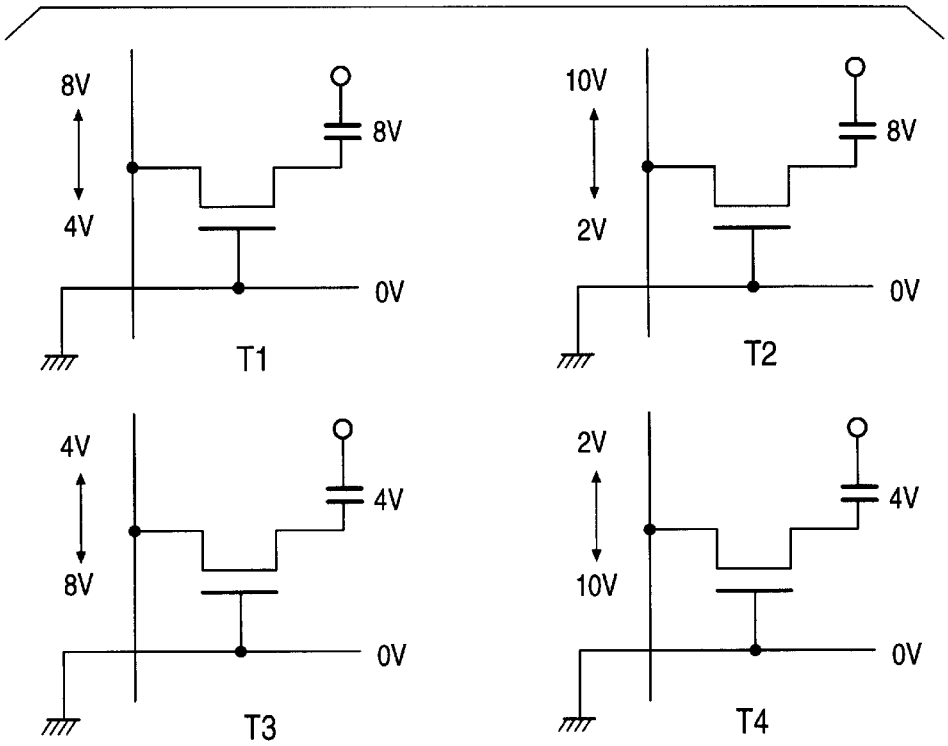
FIG. 14 consists of circuit diagrams illustrating in an example.

The horizontal scanner 4 writes video signal Vsig in accordance with horizontal start pulses HST input every horizontal period. One horizontal period includes a blanking interval-included time excluding a time assigned for writing video signal Vsig. In one horizontal period excluding the time assigned for writing the video signals, the control pulses PC are output, and voltage signal Vcr is simultaneously applied to each signal line Y. As described above, voltage signal Vcr is equal to $VsigC-\Delta V_{(MAX)}$ or less. In other words, voltage signal Vcr equal to or less than the minimum level of the video signal Vsig is applied to each signal line Y. Subsequently, in a writing period, each horizontal switch HSW is turned off at each timing, and video signal VsigC+ΔV is sampled to each signal line Y. As a result, the signal-line potential VY changes as shown bottom in FIG. 1B. When the next control pulses PC are output, voltage signal Vcr is supplied to each signal line Y, and reverse-polarity video signal Vsig=VsigC−ΔV is subsequently sampled. In this manner, according to the present invention, by causing all the signal lines Y to operate in the period T4 condition shown in FIG. 14 so as to correspond to each horizontal period, the leakage currents in the portions A and B are adjusted to an almost equivalent value, which prevents vertical crosstalk. In the first embodiment, in any one vertical period during which positive and negative video signals are applied, voltage signal Vcr is supplied. However, the present invention is not limited to the first embodiment. As described with reference to FIGS. 13 and 14, the vertical crosstalk frequently appears in, particularly a period in which the low-level video signal VsigC−ΔV is applied to each pixel LC. Accordingly, in accordance with this period, voltage signal Cr may be written at intervals of one horizontal period.

Figure 2A:
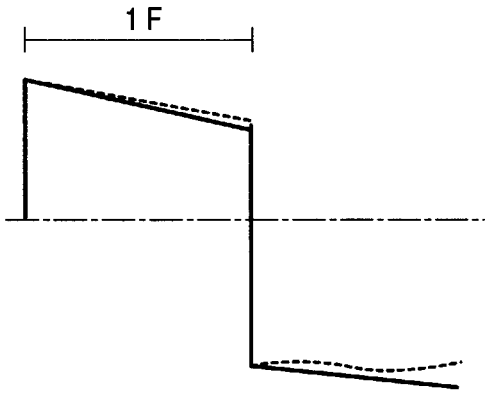
FIGS. 2A and 2B are waveform charts illustrating the operating conditions of the active-matrix display device according to the first embodiment.
Figure 2B:
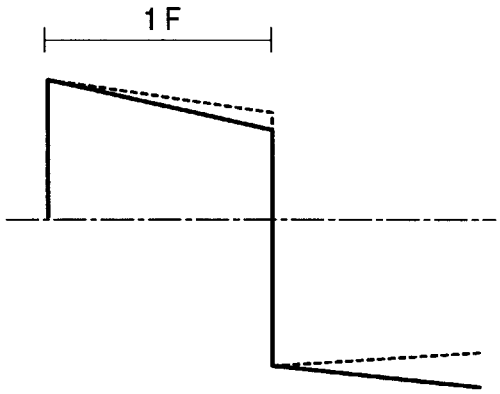
Figure 3:
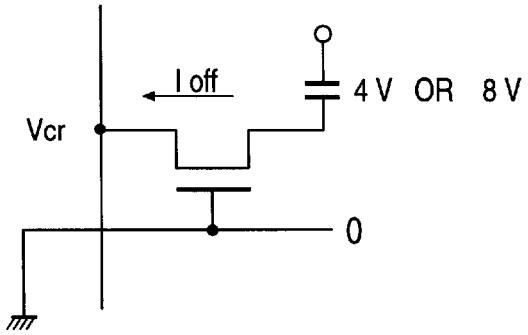
FIG. 3 is a circuit diagram showing the operating condition of the active-matrix display device according to the first embodiment.
Figure 4:
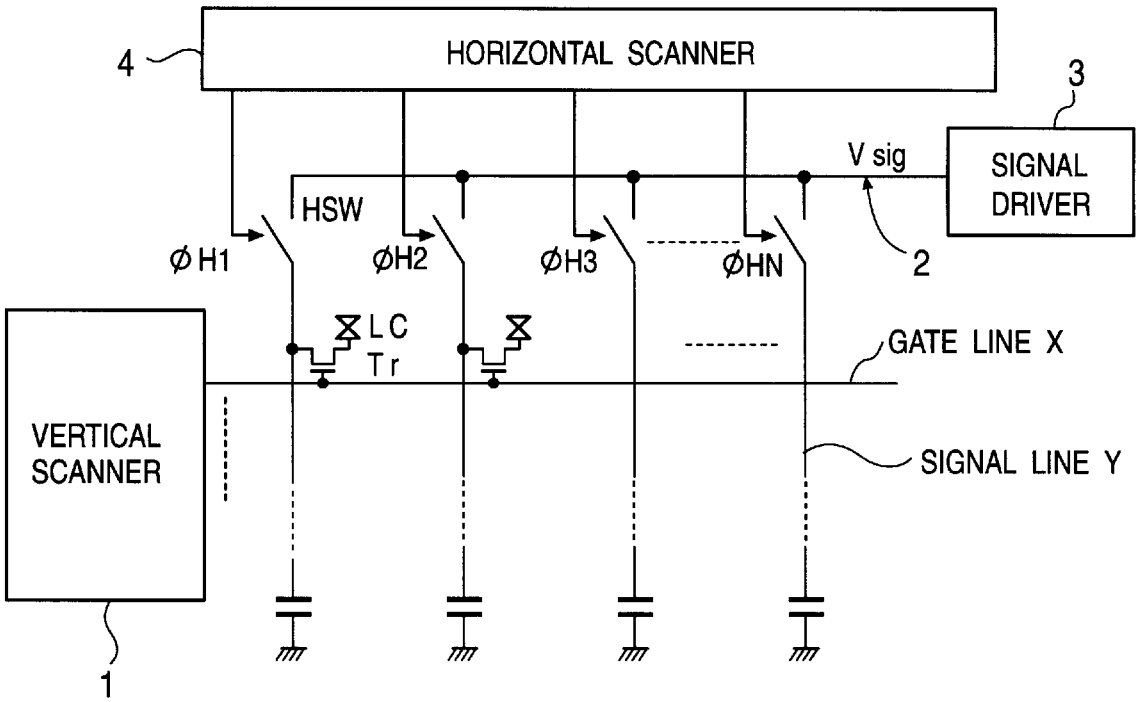
FIG. 4 is a circuit diagram showing an example of an active-matrix display device.
Figure 5:
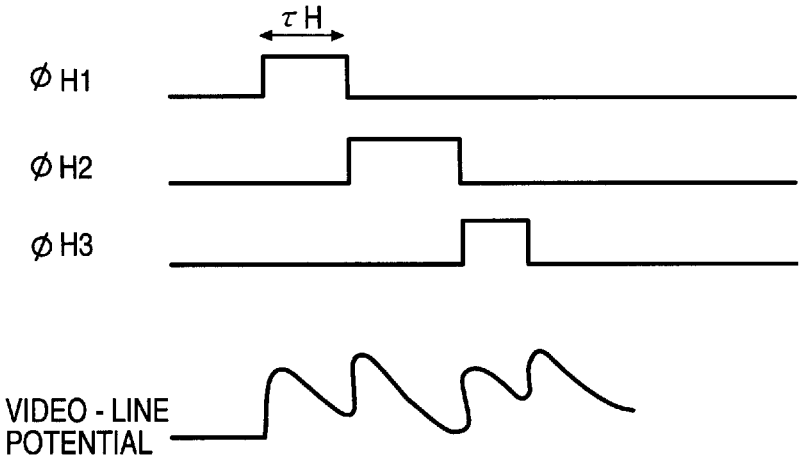
FIG. 5 is a timing chart illustrating the operating condition of the active-matrix display device shown in FIG. 5.
Figure 6:
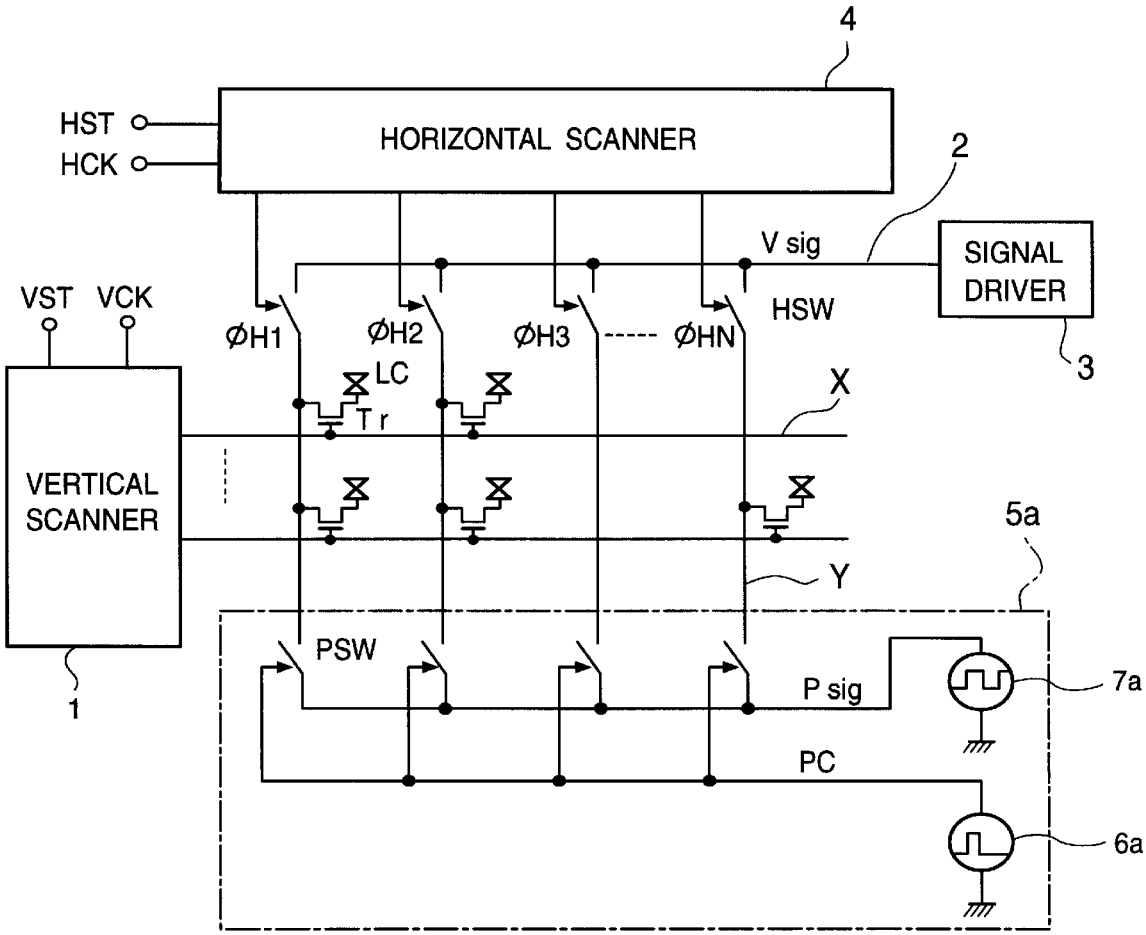
FIG. 6 is a circuit diagram showing another example of a prior-suggested active-matrix display device.
Figure 7:
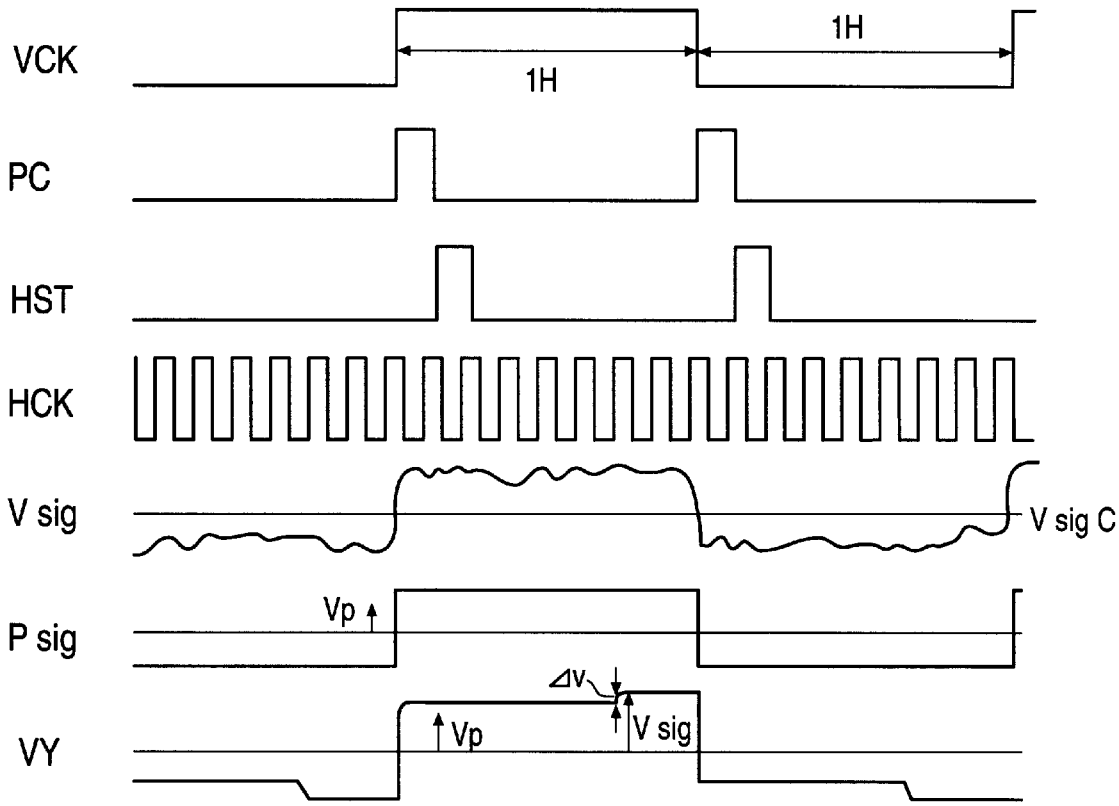
FIG. 7 is a timing chart illustrating the operating condition of the active-matrix display device shown in FIG. 6.
Figure 8:
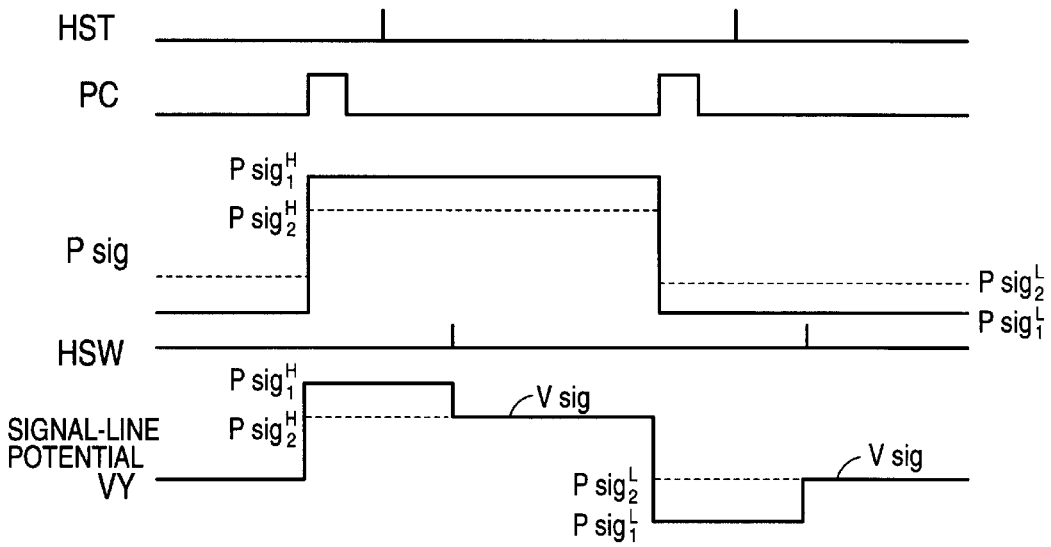
FIG. 8 is a timing chart illustrating problems of the active-matrix display device shown in FIG. 6.
Figure 12:
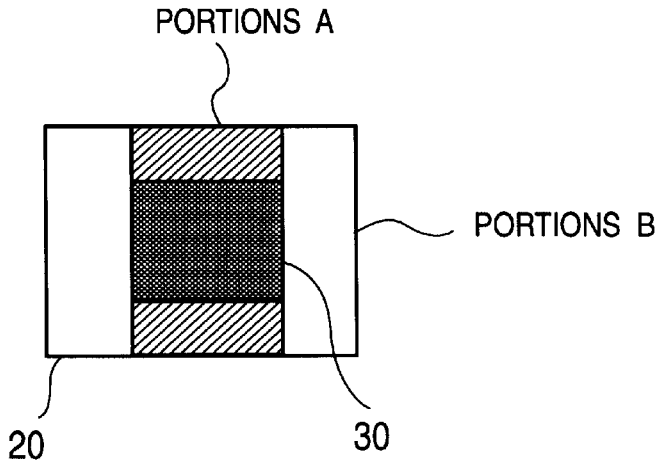
FIG. 12 is a chart illustrating problems in an example.

FIGS. 2A and 2B show changes in pixel potential during two vertical periods obtained when the operation system is employed. The solid lines represent a change in pixel potential obtained when the prevention of vertical crosstalk, according to the present invention, is performed. The dotted lines represent a change in pixel potential obtained in the conventional display-device structure. FIG. 2A shows a change in the potential of the pixels LC included in portions A shown in FIG. 12, while FIG. 2B shows a change in the potential of the pixels LC included in portions B shown in FIG. 12. According to the present invention, in order that a thin film transistor shown in FIG. 3 may operate repeatedly every horizontal period within one vertical period, the pixel potentials of portions A and B change almost similarly as shown in FIG. 2A. This means that the effective voltages of portions A and B are almost equivalent, which thus prevents the vertical crosstalk. In other words, by causing all the signal lines Y to operate as shown in FIG. 3 (equivalently to the condition T4 shown in FIG. 14), the leakage levels in portions A and B are controlled at an almost equivalent value, which prevents the vertical crosstalk.

An active-matrix display device for solving the above problem, according to a second embodiment of the present invention, will be described below by referring to FIG. 9.

Figure 1B:
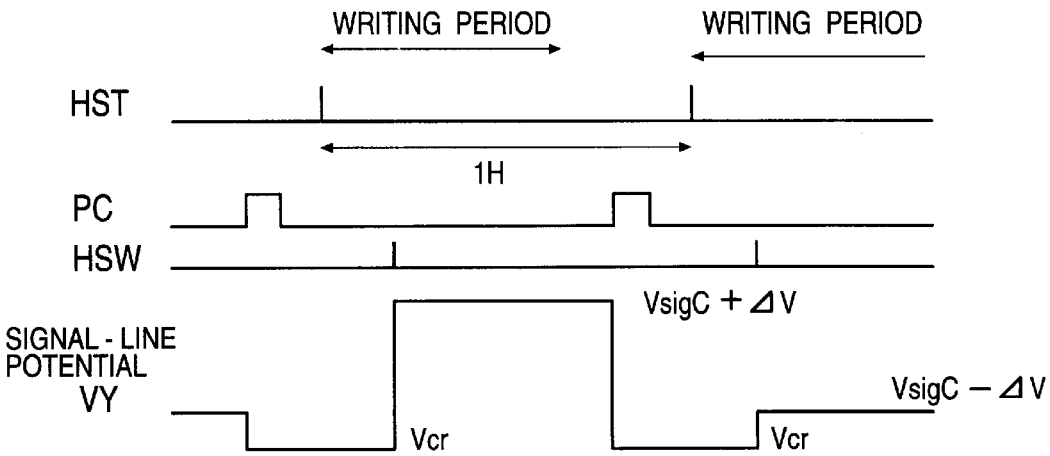
FIG. 1B is a timing chart showing the active-matrix display device according to the first embodiment.

The second embodiment is basically identical to the first embodiment shown in FIGS. 1A and 1B, and the corresponding components are denoted by the corresponding reference numerals for facile understanding. One characteristic of the active-matrix display device according to the second embodiment is that, after a voltage-applying means 5 applies a voltage equal to or less than the minimum level of video signal Vsig, it changes the voltage to the intermediate level of video signal Vsig and applies the changed voltage before video signal Vsig is written so that each signal line Y is precharged.

Figure 9:
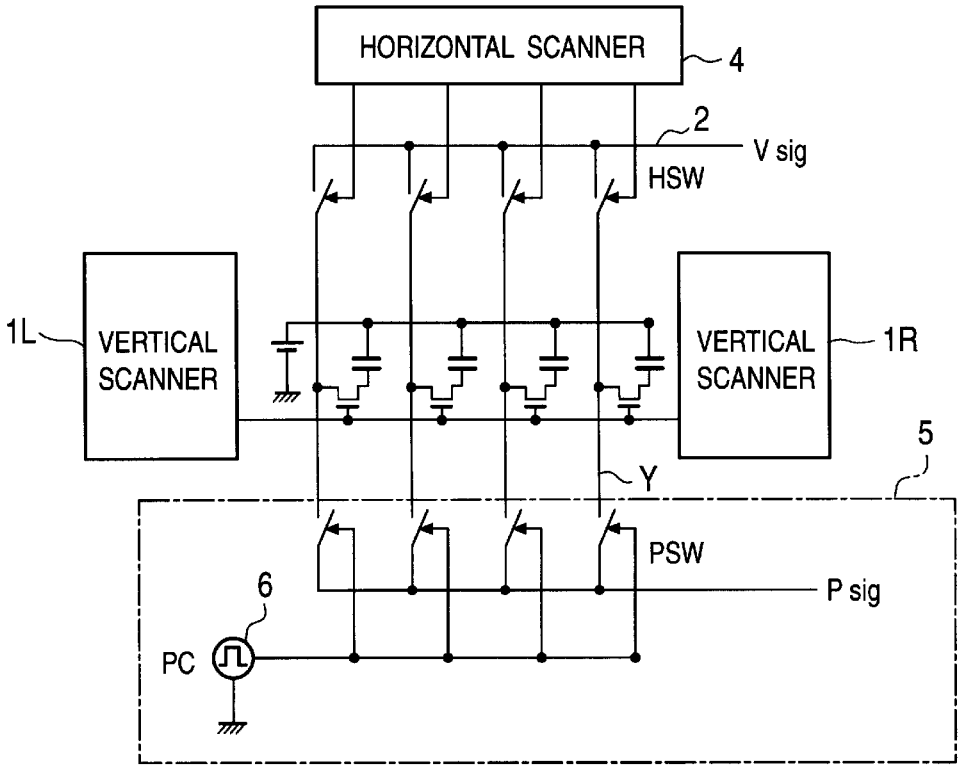
FIG. 9 is a circuit diagram showing an active-matrix display device according to a second embodiment of the present invention.
Figure 10:
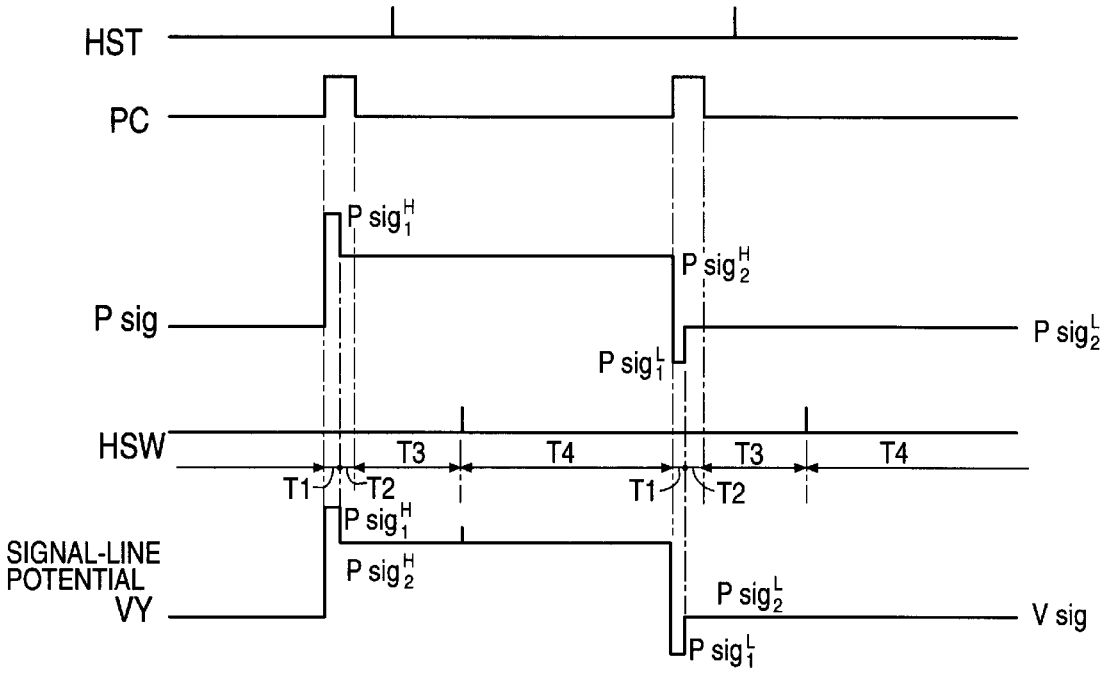
FIG. 10 is a timing chart illustrating the operating condition of the active-matrix display device according to the second embodiment.
Figure 11:
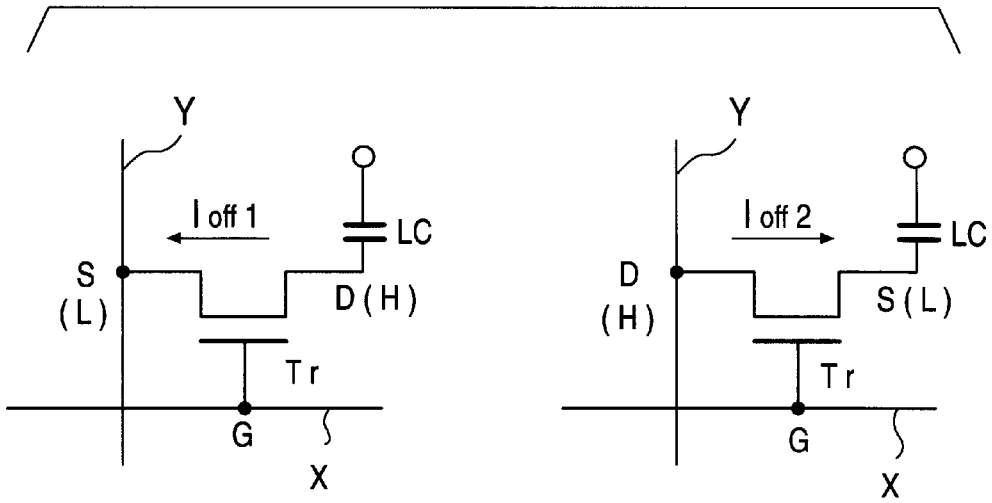
FIG. 11 consists of circuit diagrams showing a further example of a prior-suggested active-matrix display device.

The operation of the active-matrix display device shown in FIG. 9 is as follows: As shown in FIG. 10, voltage signal Psig having an illustrated waveform is applied to each signal line Y in a time during which control pulses PC are at high level in height. Voltage signal Psig at level $Psig^H{}_1$ (black level) is initially applied to each signal line Y, and while control pulses PC are still being at high level in height, the level of the applied voltage signal Psig is decreased to level $Psig^H{}_2$ (grey level). Similarly, in the reverse polarity of voltage signal Psig, voltage signal Psig at level $Psig^L{}_1$ (black level) is applied to each signal line Y while voltage pulses are being output, and while control pulses PC are still being output, the level of voltage signal Psig is decreased to level $Psig^L{}_2$ (grey level). Specifically, period T1 is used to approximately equalize the leakage level at all the signal lines Y, which prevents the vertical crosstalk. In period T2, the level of voltage signal Psig is changed to the grey level so that the difference with video signal Vsig is reduced, which eliminates the vertical fixed-pattern noise. In period T3, the level of voltage signal Psig, written in period T2, is held. By setting the level of voltage signal Psig in the above manner, both the vertical crosstalk and the vertical fixed-pattern noise can be eliminated. According to the second embodiment, a horizontal scanning circuit 4 writes video signal Vsig whose polarity is inverted every horizontal period, and in a horizontal period during which video signal having either polarity polarity at low level) is written, a voltage applying means 5 applies to each signal line Y a voltage equal to or less than the minimum level of the written video signal Vsig. In a horizontal period during which video signal Vsig having another polarity (polarity at high level) is written, a voltage equal to or more than the maximum level of the written video signal Vsig is applied to each signal line Y.

As described above, according to the present invention, by providing a voltage applying means for applying to each signal line a voltage equal to or less than the minimum level of a video signal in one horizontal period excluding a time assigned for writing the video signal in one row of pixels so as to repeatedly adjust signal leakages from all pixels to an almost equal value, vertical crosstalk as a problem of an active-matrix display device can be substantially eliminated.

What is claimed is:

1. An active-matrix display device, comprising:

a plurality of rows of gate lines;

a plurality of columns of signal lines for applying video signals corresponding at least to a black signal level and a white signal level depending on an image to be displayed;

a matrix of pixels provided in the region where said gate lines and said signal lines intersect;

a vertical scanning circuit for sequentially scanning said gate lines in one vertical period, and selecting one row of pixels every horizontal period;

a horizontal scanning circuit for sampling the video signal for each signal line before writing the video signal in the selected one row of pixels; and a voltage applying circuit for applying to each signal line a voltage equal to or less than the minimum level of the video signal corresponding to the black signal level in a horizontal period excluding a time assigned for writing the video signal in one row of pixels during that same horizontal period.

2. An active-matrix display device according to claim 1, wherein said voltage applying circuit repeatedly adjusts signal leakages from all the pixels to an almost equal value during one vertical period.

3. An active-matrix display device according to claim 1, wherein said voltage applying circuit comprises;

a circuit for precharging each signal line by changing said voltage equal to or less than the minimum level of the video signal corresponding to the black signal level to an intermediate level of the video signal corresponding to a grey signal level of the video signal and applying the intermediate level voltage to each signal line after applying the black signal level voltage to each signal line before said horizontal scanning circuit writes the video signal in each signal line.

4. An active-matrix display device according to claim 1, wherein said horizontal scanning circuit writes the video signal, whose polarity is inverted every horizontal period, and said voltage applying circuit applies to each signal line a voltage equal to or less than the minimum level of the video signal having either polarity in a horizontal period during which the video signal having either polarity is written.

5. An active-matrix driving method for driving an active-matrix display device including a plurality of rows of gate lines, a plurality of columns of signal lines, and a matrix of pixels provided in the region where said gate lines and said signal lines intersect, said active-matrix driving method comprising the steps of:

vertical scanning for sequentially scanning said gate lines during one vertical period, and selecting one row of pixels every horizontal period;

horizontal scanning for sampling a video signal for each signal line, and writing the video signal in the one row of pixels selected in one horizontal period; and applying a voltage equal to or less than a minimum level of the video signal corresponding to a black signal level in a horizontal period excluding a time assigned for writing the video signal in one row of pixels during that same horizontal period, and repeatedly performing the voltage application to adjust signal leakages from all the pixels to an almost equal value.

6. An active-matrix driving method according to claim 5, wherein, after the black signal level voltage equal to or less than the minimum level of the video signal is applied and before the video signal is written, the voltage is changed to an intermediate level of the video signal and the changed voltage is used to charge each signal line.

7. An active-matrix driving method according to claim 5, wherein the video signal, whose polarity is inverted every horizontal period, is written, and in a horizontal period during which the video signal having either polarity is written, the voltage equal to or less than the minimum level of the video signal is applied to each signal line.

* * * * *